US005560598A

United States Patent [19]

Goldkuhle

[11] Patent Number: 5,560,598

[45] Date of Patent: Oct. 1, 1996

[54] DEVICE AND METHOD FOR THE IDENTIFICATION OF OVERLAPS OF FLEXIBLE, FLAT ITEMS

[75] Inventor: Gerhard Goldkuhle, Konstanz, Germany

[73] Assignee: Licentia Patent-Verwaltungs-GmbH, Frankfurt am Main, Germany

[21] Appl. No.: 332,405

[22] Filed: Oct. 31, 1994

[30] Foreign Application Priority Data

Oct. 29, 1993 [DE] Germany ..... 43 37 004.7

[51] Int. Cl.[6] ..... B65H 7/12

[52] U.S. Cl. ..... 271/263; 271/265.04

[58] Field of Search ..... 271/262, 263, 271/265.04, 258.01, 259, 265.01

[56] References Cited

U.S. PATENT DOCUMENTS

| | | | |
|---|---|---|---|
| 3,283,163 | 11/1966 | Folmar | 271/262 X |
| 3,902,411 | 9/1975 | Gardner et al. | 271/2 X |
| 4,877,229 | 10/1989 | Delbe et al. | 271/2 |
| 4,974,825 | 12/1990 | Bizic et al. | 271/2 |

FOREIGN PATENT DOCUMENTS

| | | | |
|---|---|---|---|
| 0142538 | 7/1988 | European Pat. Off. . | |
| 4313850 | 11/1994 | Germany . | |
| 5294513 | 11/1993 | Japan | 271/263 |

*Primary Examiner*—David H. Bollinger
*Attorney, Agent, or Firm*—Spencer & Frank

[57] ABSTRACT

A device and a method are disclosed for identifying overlaps of flexible flat items being moved along a conveyance path in a conveyor segment which is configured to move the items sequentially while the items are standing on edge and such that at least one section of each of the items is deflectable perpendicularly with respect to the conveyance path. A deflection element is disposed adjacent the conveyor segment for temporarily deflecting a section of the flat items perpendicularly with respect to the conveyance path by a predetermined amount while the items are being conveyed. Each deflection element is associated with a detection device which detects an overlapping of the items based on a flip-back behavior of the temporarily deflected section of the items.

11 Claims, 3 Drawing Sheets

DEVICE AND METHOD FOR THE IDENTIFICATION OF OVERLAPS OF FLEXIBLE, FLAT ITEMS

CROSS-REFERENCE TO RELATED APPLICATION

This application claims the priority of Patent Application No. P 43 37 004.7, filed Oct. 29, 1993 in Germany, the subject matter of which is incorporated herein by reference.

BACKGROUND OF THE INVENTION

The invention relates to a device and a method for identifying overlaps of flexible flat items being moved along a conveyance path in a conveyor segment which is configured to move the items sequentially, while they are standing on edge, and such that at least one section of each of the items is deflectable perpendicularly with respect to the conveyance path.

Devices and methods for the separation of flat items are known, for example, from European Patent 0 142 538. A problem in such separation devices is the fact that so-called double-drawing errors occur which are attributable to instances where, instead of one item being drawn from a given stack, two items are drawn simultaneously. This may occur because the frictional entraining force between the front item in a stack and the second item is too great, or because the second item in the stack projects from the stack and is drawn off too early due to the fact that the alignment of the front edges of the items is non-uniform.

Undetected instances of double-drawing are of special importance in letter-sorting systems because they lead to increased missorting rates resulting from reading errors made by the automatic address identification system or from keying errors when addresses are entered manually. In addition, overlapping items created by double-drawing can increase the susceptibility of letter-sorting systems to mechanical failure. By treating identified double-drawings as reject items, however, missorting and mechanical failure can be avoided.

Problems caused by double-drawing errors can in addition be reduced by identifying item overlaps. In order to identify item overlaps, optically scannable track markings, have, for example, been applied to item surfaces. Lines, bar codes, or other patterns can be rolled or sprayed, preferably over the entire length of the item, on either its front side or its rear side or both in order to create these optically scannable track markings. Item overlaps can thereafter be detected by optically scanning these track markings because, where overlaps exist, certain patterns, such as graduation marks or lines, are usually missing or skipped. In such processes, it is necessary to pretreat the items in two general steps. While the first step involves the marking of tracks on the items, and occurs after a first item sorting the second step involves the actual identification of item overlaps, and occurs only after a second item sorting stage (for example after the detailed final sorting of letters). A clear disadvantage of the above process is that any missorting due to an overlapping of the items caused during the first item sorting stage could not be identified. Another drawback of this process is that relatively large forces are necessary for the flexing or bending of items so that possible track interruptions can be detected. Yet another drawback is that track markings may only be applied to those regions of the items that are not covered by conveyor belts, in order to prevent smudging of the surface of the items and the conveyor belts.

SUMMARY OF THE INVENTION

It is thus an object of the present invention to provide a device and a method for the identification of overlaps of flexible flat items which avoids the above disadvantages.

The above and other objects are accomplished according to the invention by the provision of a device for identifying overlaps of flexible, flat items along a conveyance path, comprising: a conveyor segment for sequentially conveying the items, while the items stand on edge, along the conveyance path such that at least one section of each item is deflectable perpendicularly with respect to the conveyance path; a deflection element disposed adjacent the conveyor segment for temporarily deflecting the at least one section perpendicularly with respect to the conveyance path by a predetermined amount while the items are being conveyed in the conveyor segment; and at least one detection means for detecting an overlapping of the items based on a flip-back behavior of the at least one section.

According to another aspect of the invention there is provided a method for identifying overlaps of flexible, flat items along a conveyance path defined by a conveyor segment for sequentially conveying the items while the items stand on edge along the conveyance path such that at least one section of each item is deflectable perpendicularly with respect to the conveyance path, comprising the steps of: temporarily deflecting a movable section of each item perpendicularly with respect to the conveyance path; and identifying an overlapping of the items by analyzing a flip-back behavior of the section.

The invention is thus based on the principle of temporarily deflecting movable sections of each item in a direction perpendicular to the conveyance path and thereafter detecting the presence of overlapping item sections by analyzing the flip-back behavior of the items. This can be done, for example, by analyzing the behavior of the items immediately after the trailing section of each of the items has flipped back into an undeflected position from a deflected position, thus leaving no section of the advancing item in a deflected position.

In a given mechanical arrangement for the deflection and flipping-back of item sections according to the invention, the flip-back behavior of the items can be analyzed in different ways. Overlapping item sections can be detected, in particular, by measuring the temporary distance between the trailing edges of the deflected item sections. Detection can also take place, however, by measuring capacity changes as an oscillator is detuning or by sensing the pressure exerted by the trailing edges on a given surface after the trailing edges have flipped back.

An advantageous feature of the invention is the fact that the identification of overlaps is largely independent of the surface finish of the items. Therefore, the device and method according to the invention do not lead to an erroneous identification of pressure-sensitive adhesive labels, stamps, bandings or windows as overlaps.

Moreover, the instant invention does not require the application of track markings to item surfaces. Thus, letter sorting systems already in existence can be easily and advantageously upgraded with the device of the instant invention.

According to the invention, the deflection of item sections can take place from either the front side or the rear side of the items. For a thorough identification of overlaps according to the invention it is advantageous to deflect the movable item sections from both the front side and the rear side of the items and to analyze the flip-back behavior of the items for each of the front and rear deflection modes. Thus, in a preferred embodiment of the invention, deflection elements are arranged in series on opposite sides of the conveyor segment to deflect the items from both the front and the rear.

In another preferred embodiment of the invention, the detection device for the detection of overlaps is provided with an illumination device for the production of light beams, and a minimum of two optical receivers associated therewith. The light beams are directed in space at a deflection region defined by the region of temporary deflection of the item sections, and the optical receivers are disposed on opposite sides of the conveyor segment in such a way that the incidence of light into the optical receivers is only interrupted simultaneously when items with trailing sections that overlap in an offset manner are deflected.

DETAILED DESCRIPTION OF THE PREFERRED EMBODIMENTS

Figure 1:
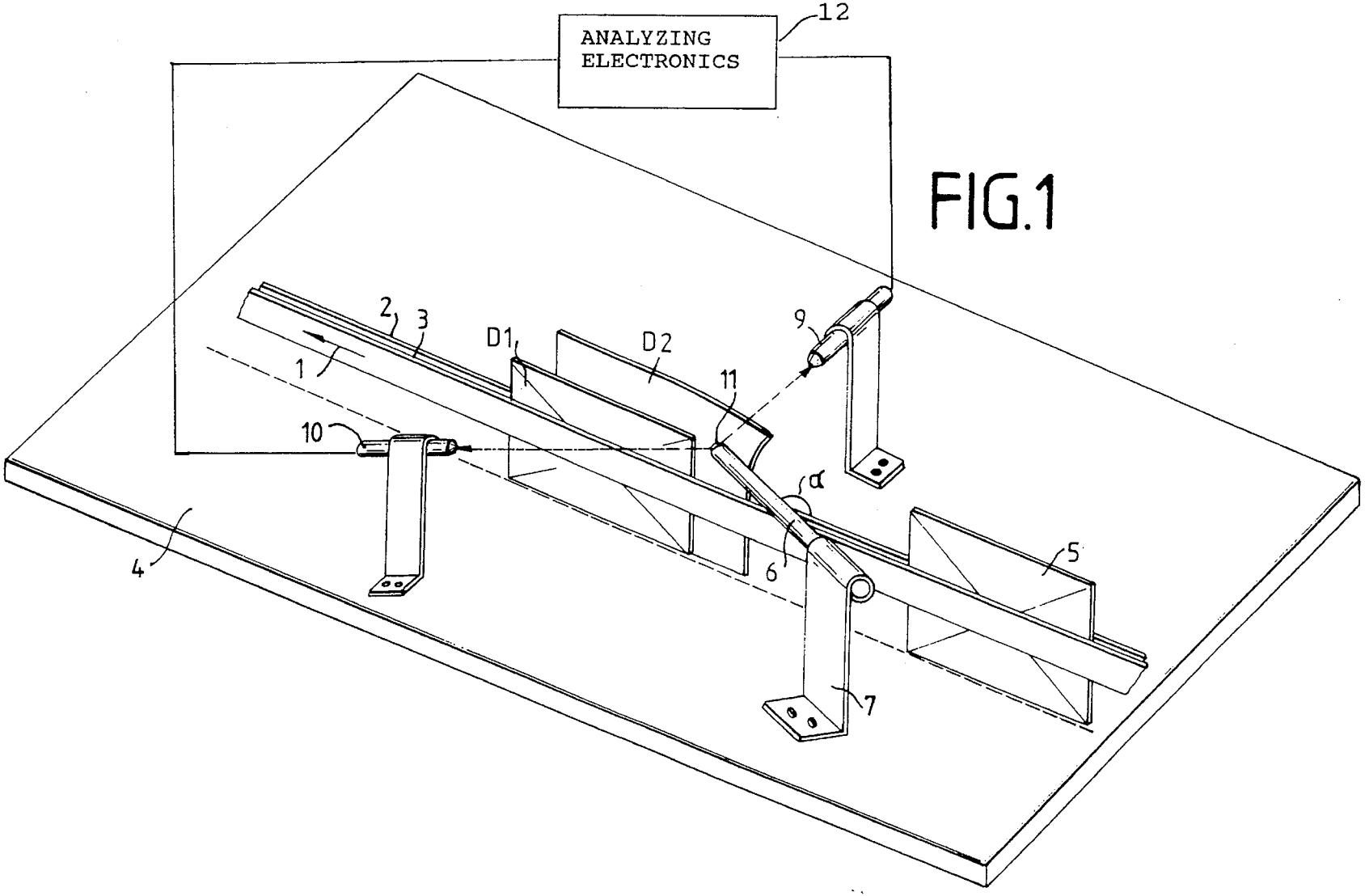
FIG. 1 is a perspective view of a preferred embodiment of the invention.

In FIG. 1, the conveyor segment 1 is provided with two conveyor belts 2 and 3 which are guided over a letter transport plate 4. To simplify matters, the driving and guide elements that are customarily used for driving and guiding the conveyor belts have not been shown. The drawing also does not show the draw-off device with which the items have been drawn off a stack before being fed into the conveyor segment. Details regarding the configuration and operation of such draw-off devices are known, for example as disclosed in German Patent No. 43 13 850.

Flat items, such as letters, long letters and postcards in various formats, are usually transported over conveyor segments such as conveyor segment 1, while standing on their longitudinal edge. In this process, the conveyor belts only cover a small portion of the total surface of the item so that rather large sections of the items project above and below the conveyor belts. It must be emphasized that the invention also relates to conveyor segments in which items are transported in a different manner than with two conveyor belts as long as it is ensured that the items project beyond a component against the edge of which the item sections can be deflected.

An item deflection element 6, preferably having a rod-shaped configuration, is laterally offset with respect to the conveyor segment. Deflection element 6 protrudes into the conveyance path so that a transported letter is forcibly deflected at sections thereof projecting beyond the conveyor belts as soon as the letter reaches the region of the conveyance path into which the deflection element protrudes. Preferably, the deflection element forms an obtuse angle $\alpha$ vis-à-vis the conveyance path so that the deflection of the respective item sections can occur slowly and gently. The distance of the deflection end of the deflection element from the plane in which the items are transported determines the maximum deflection of the item sections, and the deflection can thus be adapted to the bending properties of the items.

The deflection element is attached to a support 7 so that the element is arranged at a sufficient distance above the top edge of the conveyor belts. To avoid damaging the items, it is advantageous to provide for an attachment of the deflection element such that a predetermined maximum deflection force is not exceeded. A maximum permissible deflection force can be achieved, for example, through a rotatable suspension of the deflection element such that it exerts a predetermined counterforce on the item sections in response to a deflection thereof.

FIG. 1 shows optical receivers 9 and 10 as being disposed on opposite sides of the conveyor segment. An illumination device 11 is disposed on the deflection end of deflection element 6, emitting light beams in the direction of the optical receivers. Preferably, halogen lamps, LED's or other fast switchable light sources are used for this purpose so that the light beams are emitted with a pulse sequence between about 10 and about 100 kHz. The illumination device and the optical receivers are electrically connected to an analyzing electronic system 12 which controls and monitors the emission and reception of the light beams. In order to decrease any interference between the receiving system and any surrounding signals, apart from using a pulse repetition frequency between about 10 kHz and about 100 kHz as mentioned above, an a.c. voltage amplification of a desired magnitude is provided in the receiving element of the arrangement.

Figure 2:
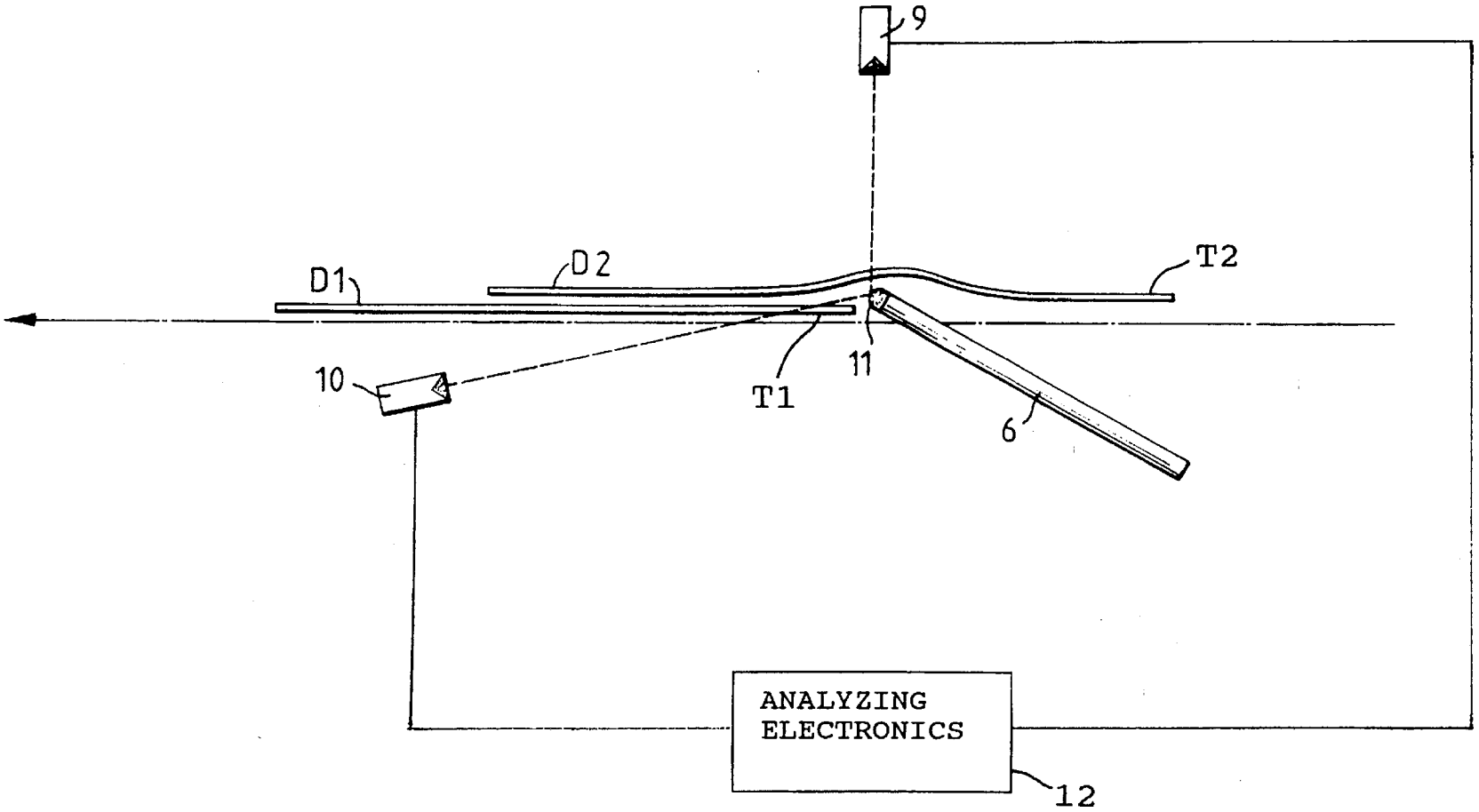
FIG. 2 is a simplified plan view of the preferred embodiment of the invention according to FIG. 1.

The mode of operation of the device is now described, with reference additionally being made to FIG. 2. As long as no item is deflected, none of the light beams that are emitted in the direction of the optical receivers 9 and 10 are interrupted. As soon as an item is deflected, however, the light beam received by optical receiver 9, which is arranged on the side to which the item is deflected, is interrupted first, and stays interrupted for as long as any section of an item remains deflected. If only a single item has been drawn off, that is, if no overlaps exist, then, as soon as the temporarily deflected trailing edge of the item has flipped back to a non-deflected position, the light beam received by optical receiver 10 is interrupted, and simultaneously with this interruption, the light beam directed toward receiver 9 resumes its reception by that receiver. During a time period that is a function of the speed with which items are transported, the light beam emitted in the direction of optical receiver 10 remains interrupted by the flipped back trailing edge of the item while the light beam directed toward receiver 9 continues being received by that receiver. Analyzing electronic system 12, which may include a suitable processor, thus analyzes the output of receivers 9 and 10 to detect the presence of an overlap of items according to Table 1 below:

TABLE 1

| receiver 9 | receiver 10 | conclusion |
|---|---|---|
| interrupted | receiving | no overlap |
| receiving | interrupted | no overlap |
| receiving | receiving | no letters |
| interrupted | interrupted | overlap |

FIG. 2 shows the configuration in plan view for an overlapping pair of item D1 and D2. With respect to deflecting member 6, item D1 constitutes a top item, and item D2 a bottom item. As can be seen, immediately after the flip-back of a trailing edge T1 of top item D1, the light beam emitted in the direction of optical receiver 10 is interrupted. At this time, however, bottom item D2 is still in the region of deflection element 6 so that the sections of D2 which project beyond the edge of the conveyor belt remain deflected and continue to interrupt the light beam emitted in the direction of optical receiver 9. Accordingly, an interruption of both light beams signals the existence of an overlap to analyzing electron system 12.

If two items are overlapping, the relevant item sections form a double layer in the region of the overlap. In order to allow the identification of overlapping items according to the afore-described procedure, it is necessary for bottom item D2 to have a section that not covered, i.e not overlapped, by top item D1, so that the deflection of bottom item D2 can remain deflected after the top item is no longer deflected. In order to identify as many overlaps as possible, it is therefore advantageous to dispose two deflection elements, together with their associated optical receivers, in series and spaced from another along and on opposite sides of the conveyance path so that the items are deflected one after the other in opposite directions, i.e., from both the front side and the rear side of the items.

Figure 3:
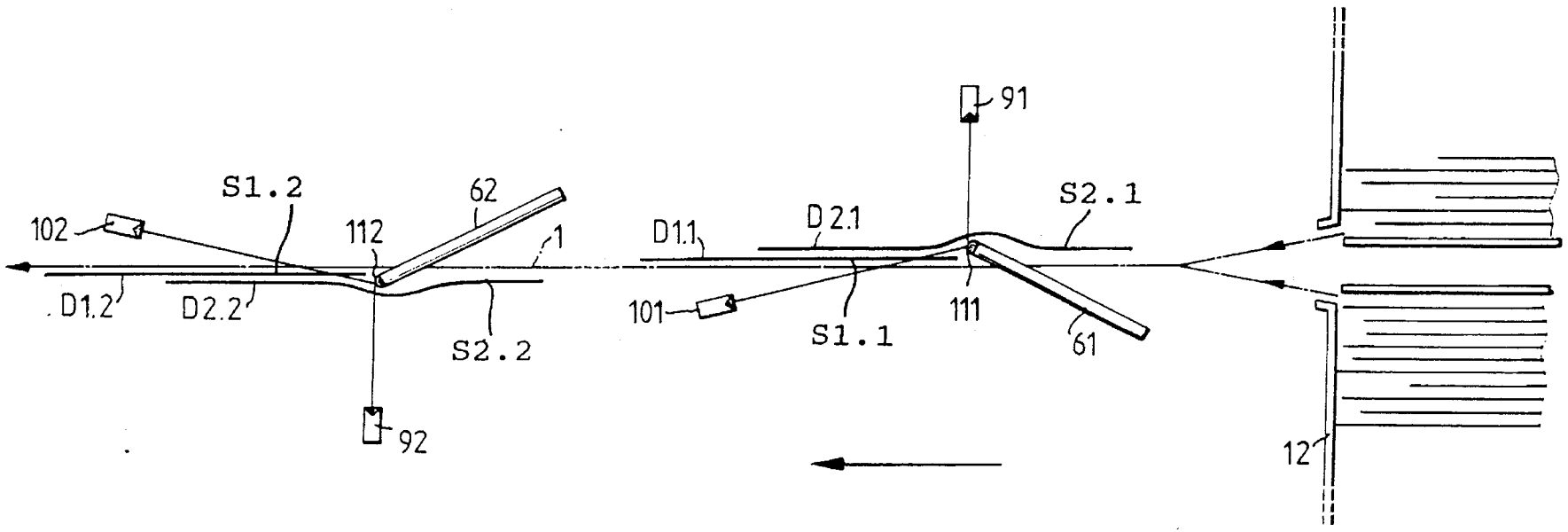
FIG. 3 is a plan view of a further preferred embodiment of the invention.

Such an arrangement is shown in the embodiment of FIG. 3. In this embodiment, after the items have been separated in a double-separation device 12, the items of conveyor segment 1 are first fed to a first deflection element 61 and then to a second deflection element 62. An illumination device 111 and optical receivers 91 and 101 are associated with deflection element 61. An illumination device 112 and optical receivers 92 and 102 are associated with deflection element 62. In this embodiment, the items are deflected from both their front side and their rear side. This arrangement allows for the detection of overlaps by appropriate analyzer electronics (not shown in FIG. 3) where a trailing section S2.1 of an item D2.1 is offset with respect to a trailing section S1.1, of an item D1.1 and also where a trailing section S2.2 of an item D2.2 is offset with respect to a trailing section S1.2 of an item D1.2, thus providing a more thorough identification of overlaps.

The foregoing is a complete description of the present invention. Various changes may be made without departing from the spirit and scope of the invention, which, therefore, should be limited only by the scope of the following claims.

What is claimed is:

1. A method for identifying overlaps of flexible, flat items along a conveyance path defined by a conveyor segment for sequentially conveying the items, while the items stand on edge, along the conveyance path such that at least one movable section of each item is deflectable perpendicularly with respect to the conveyance path, comprising the steps of:

temporarily effecting a first deflection of a movable section of each item perpendicularly with respect to the conveyance path;

identifying an overlapping of the items by analyzing a flip-back behavior of the section based on the first deflection;

temporarily effecting a second deflection of the movable section of each item perpendicularly with respect to the conveyance path; and identifying an overlapping of the items by analyzing a flip-back behavior of the section based on the second deflection.

2. The method according to claim 1, wherein the steps of temporarily deflecting comprise deflecting a section from at least one of a front side and a back side of each of the items.

3. The method according to claim 1, wherein the conveyor segment comprises conveyor belts between which the items are guided along the conveyance path, and wherein the steps of temporarily deflecting comprise deflecting a section adjacent at least one of a top edge and a bottom edge of the belts.

4. A device for identifying overlaps of flexible, flat items along a conveyance path, comprising:

a conveyor segment for sequentially conveying the items, while the items stand on edge, along the conveyance path such that at least one section of each item is deflectable perpendicularly with respect to the conveyance path;

a plurality of deflection elements disposed adjacent the conveyor segment for temporarily deflecting the at least one section perpendicularly with respect to the conveyance path by a predetermined amount while the items are being conveyed in the conveyor segment; and a plurality of detection means, each of the detection means being associated with a respective deflection element for detecting an overlapping of the items based on a flip-back behavior of the at least one section by the respective deflection element.

5. The device according to claim 4, wherein the conveyor segment comprises conveyor belts between which the items are guided along the conveyance path.

6. The device according to claim 4, wherein the deflection elements are disposed with respect to the conveyance path such that the deflection force which does not exceed a maximum predetermined deflection force is exerted on each item.

7. A device for identifying overlaps of flexible, flat items along a conveyance path, comprising:

a conveyor segment for sequentially conveying the items, while the items stand on edge, along the conveyance path such that at least one section of each item is deflectable perpendicularly with respect to the conveyance path;

a plurality of deflection elements disposed adjacent the conveyor segment for temporarily deflecting the at least one section perpendicularly with respect to the conveyance path by a predetermined amount while the items are being conveyed in the conveyor segment, the plurality of deflection elements including:

a first deflection element disposed on one side of the conveyor segment; and a second deflection element disposed on an opposite side of the conveyor segment from the one side; and at least one detection means for detecting an overlapping of the items based on a flip-back behavior of the at least one section.

8. A device for identifying overlaps of flexible, flat items along a conveyance path, comprising:

a conveyor segment for sequentially conveying the items, while the items stand on edge, along the conveyance path such that at least one section of each item is deflectable perpendicularly with respect to the conveyance path;

a deflection element disposed adjacent the conveyor segment for temporarily deflecting the at least one section perpendicularly with respect to the conveyance path by a predetermined amount while the items are being conveyed in the conveyor segment; and a detection means for detecting an overlapping of the items based on a flip-back behavior of the at least one section including:

an illumination device for directing light beams at a region of space where a temporary deflection of the item section by the deflection element takes place; and two optical receiver disposed along the conveyor segment for receiving respective light beams from the illumination device and being positioned so that light beams into both of the optical receivers are interrupted simultaneously only when sections of overlapping items are deflected by the predetermined amount.

9. The device according to claim 8, wherein the optical receivers are disposed on opposite sides of the conveyor segment.

10. The device according to claim 8, wherein the deflection element projects at an angle into the conveyance path of the items, and wherein the deflection element further includes a deflection end, the illumination device being disposed at the deflection end.

11. The device according to claim 8, wherein the illumination device emits light beams having a pulse sequence between about 10 kHz and about 100 kHz.

* * * * *